United States Patent [19]

Estabrook

[11] Patent Number: 4,686,035

[45] Date of Patent: Aug. 11, 1987

[54] CYLINDRICAL DRUM MAGNETIC SEPARATOR

[75] Inventor: Mark R. Estabrook, Rockford, Ill.

[73] Assignee: Barnes Drill Co., Rockford, Ill.

[21] Appl. No.: 758,653

[22] Filed: Jul. 24, 1985

[51] Int. Cl.[4] ..... B03C 1/12

[52] U.S. Cl. ..... 210/137; 209/219; 210/110; 210/222; 210/402; 210/405; 210/418; 210/456

[58] Field of Search ..... 210/97, 110, 157, 161, 210/222, 223, 402, 405, 456, 418, 137; 209/219, 231, 232

[56] References Cited

U.S. PATENT DOCUMENTS

| | | | |
|---|---|---|---|
| 663,764 | 12/1900 | Kreuser et al. | 209/219 |
| 1,740,578 | 12/1929 | D'Olier | 210/161 X |
| 1,845,024 | 2/1932 | Kivari | 210/161 X |
| 2,564,515 | 8/1951 | Vogel | 210/222 |
| 2,717,080 | 9/1955 | Anderson | 210/222 |
| 2,758,715 | 8/1956 | Fowler | 210/222 |
| 3,017,031 | 1/1962 | Fowler | 209/219 |
| 3,346,113 | 10/1967 | Lundmark | 210/222 X |
| 3,522,883 | 8/1970 | Steckhan | 210/222 |
| 3,561,823 | 2/1971 | Meuret | 210/161 X |
| 3,804,256 | 4/1974 | Marriott et al. | 210/222 |
| 4,110,218 | 8/1978 | Marriott et al. | 210/223 |
| 4,199,455 | 4/1980 | Estabrook | 210/223 |

*Primary Examiner*—Richard V. Fisher
*Assistant Examiner*—W. Gary Jones
*Attorney, Agent, or Firm*—Leydig, Voit & Mayer

[57] ABSTRACT

A separator with a magnetic drum which rotates through a well-defined liquid flow path to separate magnetic particles from liquid delivered to the flow path by way of a trough. A weir extends between the trough and the drum to define a gap at the entry end of the flow path. The weir is hinged to swing downwardly and upwardly to automatically increase and decrease the width of the gap when the incoming flow rate increases and decreases, respectively, the weir thus acting to maintain the liquid level in the trough substantially constant at various incoming flow rates. The trough is shaped to spread the incoming liquid across the length of the drum in a streamlined manner. The housing of the separator is of a fabricated construction enabling easy removal and replacement of an arcuate apron which coacts with the drum and the housing to define the flow path.

9 Claims, 7 Drawing Figures

CYLINDRICAL DRUM MAGNETIC SEPARATOR

BACKGROUND OF THE INVENTION

This invention relates generally to apparatus for separating particles from dirty liquid and, more particularly, to a magnetic separator of the type commonly used to clean machine tool coolant by magnetically removing entrained metal chips and fine particles from the coolant.

In such a separator, dirty liquid is delivered to a flow path defined in part by a curved apron extending around the lower side of a rotatable drum having a magnetic outer surface. As the liquid flows to and around the drum, the particles are magnetically attracted to the drum and thus are removed from the liquid. The drum is slowly rotated to raise the collected particles out of the flow path and to enable the particles to be scraped from the drum.

In many prior magnetic separators, a change in the flow rate of the dirty liquid supplied to the drum can result in a change of the level of liquid in contact with the drum. If the incoming flow rate is extremely low, the degree of contact between the liquid and the drum may not be sufficient to effect good separation. If the flow rate is extremely high the drum may not be capable of handling the flow and may cause an overflow. It has, therefore, been necessary in many cases to adjust the separator, either manually or with a relatively complex control system, in an effort to correlate the flow past the drum with the incoming flow rate and to keep a substantially constant level of liquid in contact with the drum.

SUMMARY OF THE INVENTION

One of the general aims of the present invention is to provide a new and comparatively simple magnetic separator in which the level of dirty liquid in contact with the drum is automatically kept substantially constant even though the flow rate of the incoming dirty liquid varies over a wide range, the separator automatically maintaining the substantially constant liquid level without the need of special controls.

A more detailed object of the invention is to achieve the foregoing by uniquely controlling the flow of liquid past the drum with a hinged weir which responds to the pressure of the incoming liquid and automatically opens and closes to increase and decrease the flow rate around the drum when the incoming flow rate increases and decreases, respectively.

Still another object is to provide a novel hinged weir adapted to be swung closed by the magnetic attraction of the drum and whose hinging action is not fouled or retarded by contaminants in the liquid.

A further object of the invention is to provide a uniquely shaped trough for delivering the flow of dirty liquid to the drum and for spreading the flow substantially uniformly along the length of the drum in a streamlined manner.

The invention also resides in the novel and relatively simple fabricated construction of the drum to enable the apron of the flow path to be replaced quickly and easily.

These and other objects and advantages of the invention will become more apparent from the following detailed description when taken in conjunction with the accompanying drawings.

DETAILED DESCRIPTION OF THE PREFERRED EMBODIMENT

Figure 1:
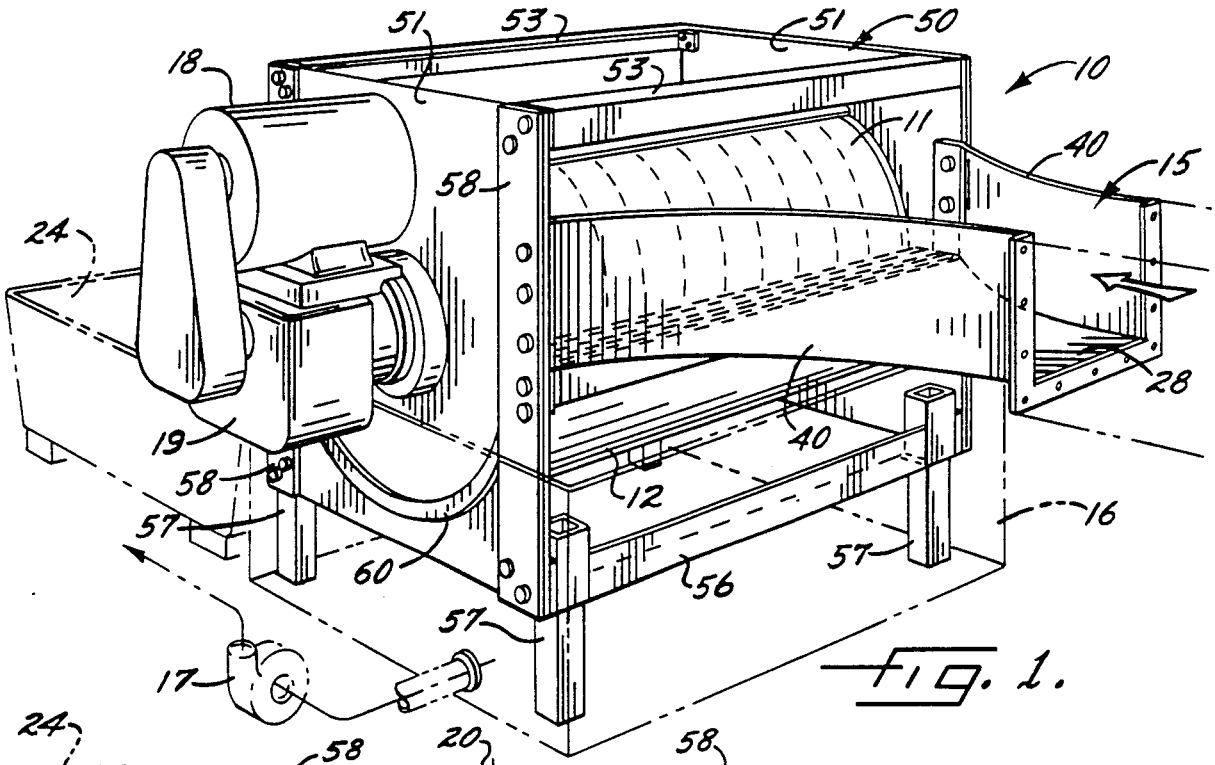
FIG. 1 is a perspective view of a new and improved magnetic separator incorporating the unique features of the present invention.

As shown in the drawings for purposes of illustration, the invention is embodied in apparatus 10 for removing metal chips, particles and the like from a flow of dirty liquid such as machine tool coolant circulated by a machine tool system. The particular apparatus which has been illustrated is a magnetic separator having a generally cylindrical drum 11 adapted to be rotated about a horizontal axis, the interior of the drum carrying permanent magnets (not shown) which cause the outer peripheral surface of the drum to be magnetized.

Figure 7:
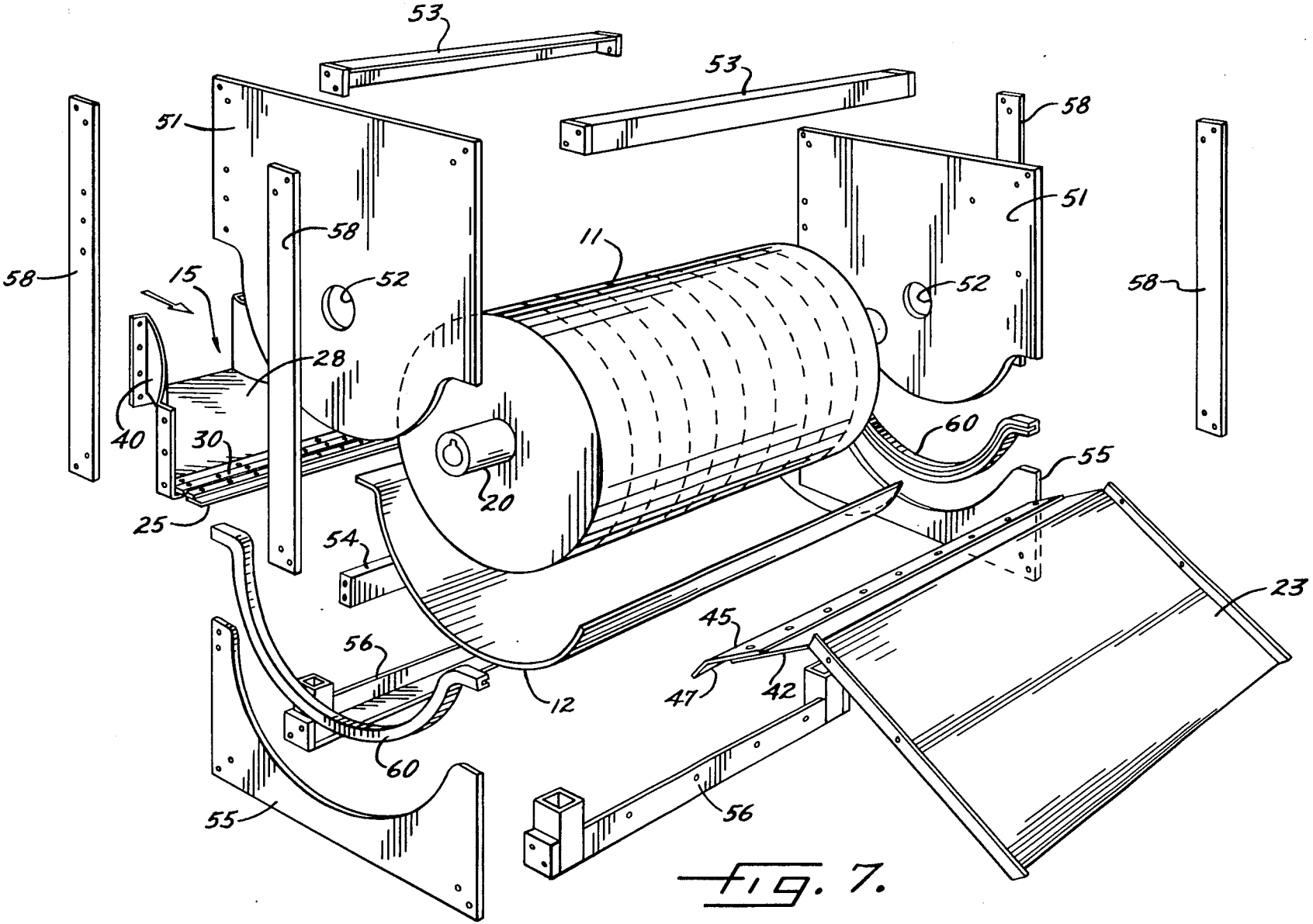
FIG. 7 is an exploded perspective view of certain parts of the separator.

Located below the drum 11 is an apron 12 (FIGS. 3 and 7) which coacts with the drum to define an arcuate flow path 13 (FIG. 3) for the coolant. The apron is in the form of a curved metal plate having a concavely curved upper surface concentric with and spaced outwardly from the drum. Dirty coolant from the machine tool system is delivered to the entry end of the arcuate flow path by way of a generally horizontal trough 15 and flows downwardly and clockwise around the drum. During such flow, the magnetic outer surface of the drum attracts the chips and particles to separate the same from the coolant and to form a cake of swarf on the drum. Clean coolant in the flow path 13 spills over the discharge end of the apron 12 and into a clean coolant tank 16 for return to the machine tool system by means of a pump 17 (FIG. 1).

In this particular instance, the drum 11 is rotated continuously and in a counterclockwise direction at a relatively slow rate of about 1.8 RPM by a motor 18 acting through a speed reducer 19 (FIG. 1) connected to a central shaft 20 (FIGS. 3 and 6) of the drum. As the drum rotates, the swarf is lifted out of the curved flow path 13 and the dirty coolant in the trough 15 and is subsequently scraped off of the drum. Swarf scraped from the drum gravitates down an inclined chute 23 (FIG. 3) and into a waste container 24.

The incoming flow rate of dirty coolant delivered to the separator 10 may vary over a wide range. It is desirable to keep the coolant in the trough 15 in contact with a large area of the drum 11 as long as possible in order to effect optimum separation. At the same time, the flow rate past the drum must be sufficiently high to accommodate the incoming flow from the machine tool system in order to keep the trough from overflowing.

In accordance with one aspect of the present invention, a hinged weir 25 (FIGS. 3 to 5) extends from the trough 15 to the drum 11 and defines a gap 26 (FIG. 4) at the entry end of the arcuate flow path 13. When the incoming flow rate is high, the increasing pressure of the coolant in the trough 15 causes the weir 25 to automatically swing open (see FIG. 5) and increase the width of the gap 26 so as to allow a greater flow of liquid past the drum and into the arcuate flow path 13. When the incoming flow rate decreases, the weir automatically closes to reduce the width of the gap and reduce the flow rate past the drum. In this way, the level of the liquid in the trough 15 is kept substantially constant at various incoming flow rates so as to effect good separation while enabling the separator 10 to accommodate high flow rates from the machine tool system.

More specifically, the present weir 25 is in the form of an elongated and horizontally extending flat strip preferably made of a magnetic material such as steel. The weir herein is located at approximately a three o'clock position relative to the drum but could be located at various positions as long as the weir is disposed so as to cause the width of the gap 26 to increase and decrease when the weir swings downwardly and upwardly, respectively.

To mount the weir 25 for downward and upward swinging, the weir is supported on the bottom wall 28 (FIG. 4) of the trough 15 by a living hinge 30. Such a hinge may, for example, comprise an elongated strip made of resiliently yieldable material such as polypropylene and formed with a longitudinally extending groove 31 in its upper surface. One margin of the hinge is attached to the weir by suitable fasteners 32 (e.g., screws or rivets) while the other margin of the hinge is attached by similar fasteners 33 to an elongated steel mounting strip 34. The latter rests on the bottom wall 28 of the trough and is fastened to the bottom wall by screws 35 which extend through elongated slots 36 in the mounting strip. By loosening the screws 35, the weir 25 may be adjusted toward and away from the drum 11 to establish the initial width of the gap 26.

Figures 3, 4, 5, 6:
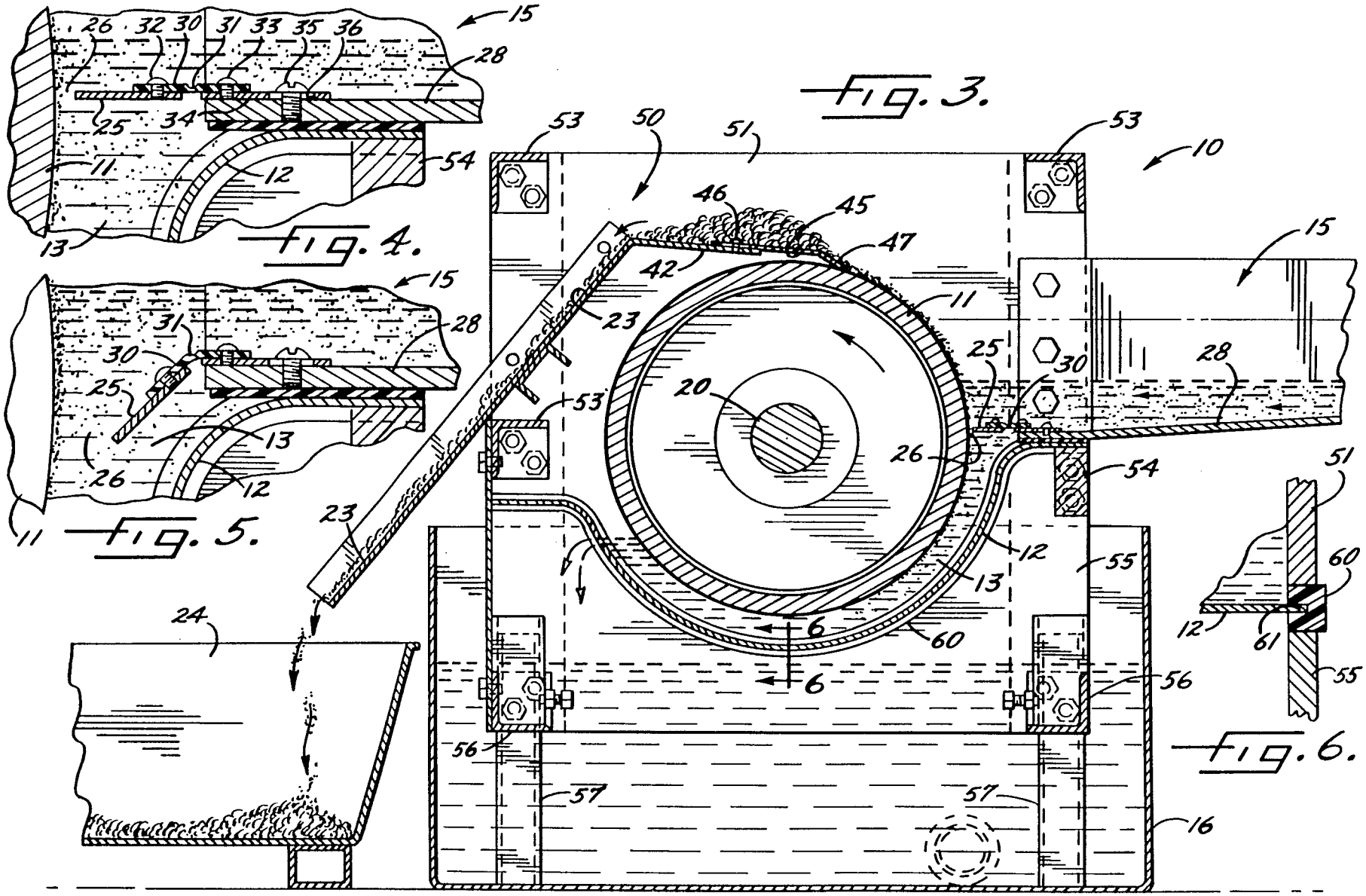
FIG. 3. is an enlarged fragmentary cross-section taken substantially along the line 3—3 of FIG. 2.
FIG. 4 is an enlarged view of certain parts illustrated in FIG. 3 and shows the weir in a closed position.
FIG. 5 is a view similar to FIG. 4 but shows the weir in an open postion.
FIG. 6. is an enlarged fragmentary cross-section taken substantially along the line 6—6 of FIG. 3.

When the incoming flow rate is relatively low, the weir 25 occupies a substantially horizontal position as shown in FIGS. 3 and 4 and thus the gap 26 between the weir and the drum 11 is relatively narrow. As a result, the entry end of the arcuate flow path 13 is restricted and thus the coolant is held at a certain level in the trough 15 so as to contact a substantial arc of the drum. When the incoming flow rate increases, the pressure acting against the weir becomes greater and, as a result of the hinge 30, the weir swings downwardly away from the drum about a pivot axis defined by the groove 31 and thereby increases the width of the gap 26 as shown in FIG. 5. Accordingly, the flow rate of coolant past the drum and into the arcuate flow path 13 is increased so as to hold the level of coolant in the trough 15 substantially constant and to prevent the trough from overflowing. When the incoming flow rate subsequently decreases, the weir is returned upwardly by virtue of the drum magnetically attracting the weir.

Thus, the weir 25 automatically self-adjusts to keep a substantially constant level of coolant in the trough 15. As a result, the drum 11 may accommodate widely varying flow rates and may effect extremely good separation at lower flow rates. Because the hinge 30 is formed from a single resiliently yieldable strip, the hinge may experience a long service life and is not susceptible to being fouled by particles in the coolant.

Figure 2:
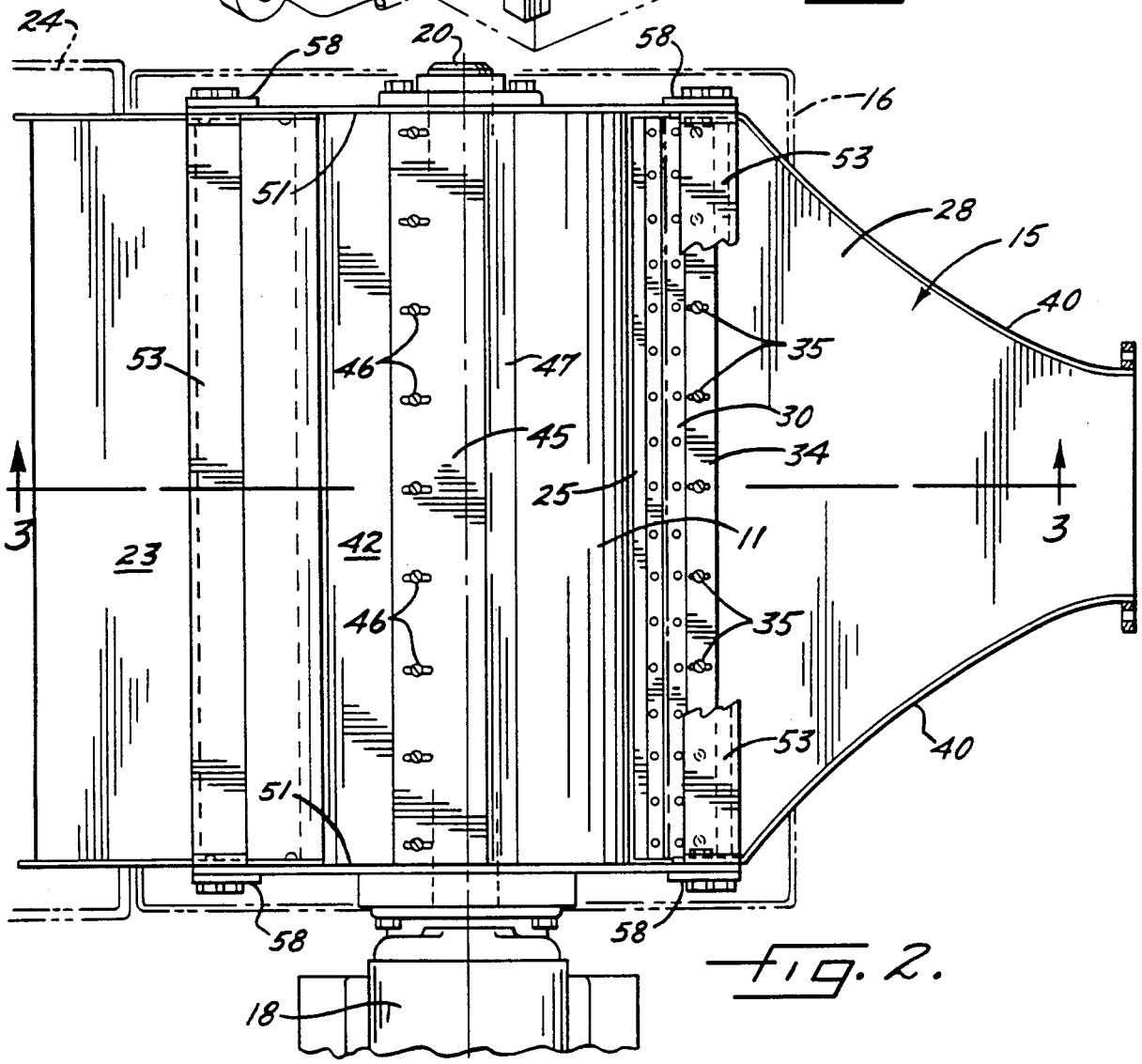
FIG. 2 is a top plan view of the separator shown in FIG. 1.

The trough 15 is of a unique construction which effects substantially uniform distribution of the incoming coolant across the length of the drum 11. As shown in FIGS. 1 and 2, the trough includes two spaced side walls 40 upstanding from the bottom wall 28. As the side walls progress toward the drum, they diverge away from one another so as to cause the trough to flare from a relatively narrow inlet end to a much wider discharge end whose width is substantially equal to the length of the drum. In addition, the inboard sides of the side walls are convexly curved (see FIG. 2). The flared relation of the side walls together with the curvature thereof causes the incoming coolant to be spread uniformly along the length of the drum in a streamlined manner.

To remove the collected swarf from the drum 11, the upper end of the chute 23 is formed with a substantially horizontal flange 42 (FIG. 3) which supports a scraper 45. Advantageously, the scraper is formed by a strip of spring steel which is cantilevered on the flange 42 as indicated at 46. The scraper is magnetically attracted downwardly into contact with the periphery of the drum 11 at about a one o'clock position. Swarf is removed from the drum by the scraper and is moved from right to left along the scraper for discharge down the chute 23. The free end portion 47 of the scraper is inclined downwardly and acts as a dam to force coolant in the swarf back to the trough 15. With this arrangement, there is no need for squeegee rollers or the like for squeezing coolant from the removed swarf.

The separator 10 includes a housing 50 (FIG. 1) which is of a relatively simple fabricated construction to facilitate removal and replacement of the apron 12. Herein, the housing 50 includes a pair of upper vertical side plates 51 (FIG. 7) located at opposite ends of the drum 11 and formed with holes 52 which receive the shaft 20. The plates 51 are rigidly tied together by two horizontally extending upper bars 53 which are bolted to the plates. The lower end portions of the plates define the sides of the arcuate flow path 13. As shown in FIG. 1, the side walls 40 of the trough 15 are bolted to the plates 51 while the bottom wall 28 of the trough rests on a horizontal bar 54 (FIG. 3) extending between the plates.

The housing 50 further includes a pair of lower vertical side plates 55 (FIG. 7) located below the upper plates 51 and tied rigidly together by two lower horizontally extending bars 56 which are bolted to the plates. Four vertical legs 57 (FIGS. 1 and 3) are connected to the bars and support the housing 50 in the clean coolant tank 16. The upper and lower plates 51 and 55 of each pair are tied rigidly together by vertically extending bars 58 (FIG. 7) bolted to the plates.

Each upper plate 51 is separate from the underlying lower plate 55 and includes a convex lower end portion which fits into a concave cut-out in the lower plate in spaced relationship with the cut-out. An arcuate sealing gasket 60 (FIGS. 1, 6 and 7) is sandwiched into each space and is formed with a groove 61 (FIG. 6) which receives the adjacent end of the apron 12. Thus, the gaskets seal the apron to the side plates 51 to keep dirty coolant in the arcuate flow path 13 from leaking into the clean coolant tank 16. By unbolting and separating the various plates, both the apron and the gaskets may be easily removed and replaced when damage or wear occurs.

I claim:

1. Apparatus for cleaning dirty liquid containing magnetic particles, said apparatus comprising a generally cylindrical drum mounted to rotate about a generally horizontal axis and having a magnetic outer peripheral surface, means cooperating with said drum to define path for dirty liquid to pass around and beneath the drum for collection of the magnetic particles on the outer surface of the drum, said flow path having an entry end at one side of said drum, and means for delivering a supply of dirty liquid to the entry end of said flow path, the improvement in said apparatus comprising, an elongated weir located at the entry end of said flow path, said weir extending generally horizontally alongside the outer periphery of the drum and extending generally radially of the drum, said weir being submerged in the supply of dirty liquid and coacting with the drum to define a gap permitting liquid from said supply to pass between said weir and said drum, and means mounting said weir for downward and upward swinging relative to said drum about a pivot axis extending parallel to said axis of the drum, the pivot axis of the weir being located so as to enable the weir to swing downwardly and upwardly to increase and decrease the width of said gap when the pressure of the dirty liquid in said supply increases and decreases, respectively.

2. Apparatus as defined in claim 1 in which said mounting means comprise an elongated and resiliently flexible strip of material formed with a living hinge which extends along the strip.

3. Apparatus as defined in claim 2 in which said strip is made of plastic, said hinge being defined by a groove formed in and extending along the upper side of the strip.

4. Apparatus as defined in claim 2 in which said weir is made of magnetic material and is attracted upwardly by the magnetic surface of said drum when the pressure of the dirty liquid in said supply decreases.

5. Apparatus as defined in claim 1 in which said delivering means comprise a trough having two upright side walls spaced from one another and extending away from one side of said drum, said side walls flaring away from one another as said side walls progress toward said one side of said drum.

6. Apparatus as defined in claim 5 in which the inboard sides of said side walls are convexly curved.

7. Apparatus for cleaning dirty liquid containing magnetic particles, said apparatus cmprising a generally cylindrical drum having a generally horizontally extending axis and having a magnetic outer surface, a pair of upper upright side plates located at opposite ends of said drum and supporting said drum to rotate about its own axis, an apron underlying said drum and extending between said upper side plates, said apron having a concave and substantially arcuate upper surface located outwardly of said substantially concentric with the outer surface of the drum and coacting with the drum and the upper side plates to define a flow path for liquid beneath the drum, a pair of lower upright side plates located at opposite ends of said drum and positioned below said apron, said apron having one end sandwiched between one upper side plate and the adjacent lower side plate and having an opposite end sandwiched between the other upper and lower side plates, gasket means sealing the ends of said apron between said upper and lower side plates, and means detachably but rigidly fastening said upper and lower side plates and said apron together as a unit.

8. Apparatus as defined in claim 7 in which said fastening means comprise bars connected to and extending vertically between each upper and lower side plate, bars connected to and extending horizontally between each upper side plate, and bars connected to and extending horizontally between each lower side plate.

9. Apparatus as defined in claim 7 in which said flow path includes an entry end at one side of said drum, means for delivering a supply of dirty liquid to the entry end of said flow path, an elongated weir located at the entry end of said flow path and extending generally horizontally alongside the outer periphery of the drum, said weir being submerged in the supply of dirty liquid and coacting with the drum to define a gap permitting liquid from said supply to pass between said weir and said drum, and means mounting said weir for downward and upward swinging relative to said drum about a pivot axis extending parallel to the axis of the drum, the pivot axis of the weir being located so as to enable the weir to swing downwardly and upwardly to increase and decrease the width of said gap when the pressure of the dirty liquid in said supply increases and decreases, respectively.

* * * * *